US006149302A

United States Patent [19]

Taheri

[11] Patent Number: 6,149,302

[45] Date of Patent: Nov. 21, 2000

[54] PLASTIC BAG WITH TAMPER-EVIDENT CLOSURE

[76] Inventor: Nossi Taheri, 1220 Regency Rd. NW., Atlanta, Ga. 30327

[21] Appl. No.: 09/394,639

[22] Filed: Sep. 13, 1999

Related U.S. Application Data

[60] Provisional application No. 60/132,881, May 5, 1999.

[51] Int. Cl.[7] ..... B65D 33/34

[52] U.S. Cl. ..... 383/5; 383/61; 383/84; 383/203; 383/209

[58] Field of Search ..... 383/5, 203, 204, 383/61, 78, 84, 66, 207, 208, 209

[56] References Cited

U.S. PATENT DOCUMENTS

| | | | |
|---|---|---|---|
| Re. 26,991 | 11/1970 | Luca . | |
| Re. 28,959 | 9/1976 | Naito . | |
| Re. 28,969 | 9/1976 | Naito . | |
| Re. 29,208 | 5/1977 | Naito . | |
| Re. 33,674 | 8/1991 | Uramoto . | |
| Re. 34,554 | 3/1994 | Ausnit . | |
| 3,181,583 | 5/1965 | Lingenfelter . | |
| 3,226,787 | 1/1966 | Ausnit . | |
| 3,312,339 | 4/1967 | Million . | |
| 3,338,284 | 8/1967 | Ausnit . | |
| 3,385,428 | 5/1968 | Kugler . | |
| 3,462,332 | 8/1969 | Goto . | |
| 3,473,589 | 10/1969 | Gotz . | |
| 3,625,270 | 12/1971 | Skendzic . | |
| 3,679,511 | 7/1972 | Ausnit . | |
| 3,685,562 | 8/1972 | Ausnit . | |
| 3,780,781 | 12/1973 | Uramoto . | |
| 3,846,209 | 11/1974 | Howard . | |
| 3,852,386 | 12/1974 | Behr . | |
| 3,889,871 | 6/1975 | White . | |
| 3,904,468 | 9/1975 | Noguchi . | |
| 4,101,355 | 7/1978 | Ausnit . | |
| 4,241,865 | 12/1980 | Ferrell . | |
| 4,279,677 | 7/1981 | Takahashi . | |
| 4,290,467 | 9/1981 | Schmidt . | |
| 4,295,915 | 10/1981 | Sakaguchi et al. . | |
| 4,306,924 | 12/1981 | Kamp . | |
| 4,428,788 | 1/1984 | Kamp . | |
| 4,484,352 | 11/1984 | Katzin . | |
| 4,522,678 | 6/1985 | Zieke . | |
| 4,555,282 | 11/1985 | Yano . | |
| 4,557,384 | 12/1985 | Membrino . | |
| 4,572,377 | 2/1986 | Beckett | 383/5 |
| 4,582,549 | 4/1986 | Ferrell . | |
| 4,589,145 | 5/1986 | Van Erden et al. . | |
| 4,615,045 | 9/1986 | Siegel | 383/5 |
| 4,620,320 | 10/1986 | Sullivan . | |
| 4,630,311 | 12/1986 | Bentson . | |
| 4,672,723 | 6/1987 | Hugues et al. . | |
| 4,682,366 | 7/1987 | Ausnit et al. . | |
| 4,699,607 | 10/1987 | Lambrecht . | |
| 4,731,911 | 3/1988 | Gould . | |
| 4,736,496 | 4/1988 | Fisher et al. . | |
| 4,741,789 | 5/1988 | Zieke et al. . | |
| 4,744,674 | 5/1988 | Nocek . | |
| 4,755,248 | 7/1988 | Geiger et al. . | |
| 4,756,629 | 7/1988 | Tilman et al. . | |
| 4,824,261 | 4/1989 | Provost | 383/61 X |
| 4,835,835 | 6/1989 | Gould . | |

(List continued on next page.)

FOREIGN PATENT DOCUMENTS

| | | | |
|---|---|---|---|
| 38-18345 | 11/1935 | Japan . | |
| 2250011 | 5/1992 | United Kingdom | 383/5 |

OTHER PUBLICATIONS

Duramark Article "Double–pocket specimen bag" (With safe—entry feature), 1996.

Brochure by ITW Minigrip, Inc. for the "minigrip", 1988.

*Primary Examiner*—Jes F. Pascua

*Attorney, Agent, or Firm*—Gardner & Groff, P.C.

[57] ABSTRACT

A bag having tamper-evident features including an adhesive flap foldable to cover the mouth of the bag to deter and indicate tampering with the contents. Indicia on the bag are visibly altered by attempts to release the adhered flap. A tear zone can be provided to facilitate detachment of a portion of the bag without cutting. Reclosable closure elements also can be provided.

24 Claims, 7 Drawing Sheets

U.S. PATENT DOCUMENTS

| | | | |
|---|---|---|---|
| 4,846,585 | 7/1989 | Boeckmann et al. . | |
| 4,846,586 | 7/1989 | Bruno . | |
| 4,854,017 | 8/1989 | Kamp . | |
| 4,863,285 | 9/1989 | Claxton . | |
| 4,892,414 | 1/1990 | Ausnit . | |
| 4,894,975 | 1/1990 | Ausnit . | |
| 4,907,321 | 3/1990 | Williams . | |
| 4,927,271 | 5/1990 | Branson . | |
| 4,930,905 | 6/1990 | Sharps, Jr. . | |
| 4,947,525 | 8/1990 | Van Erden . | |
| 4,985,192 | 1/1991 | Roeder et al. . | |
| 5,012,561 | 5/1991 | Porchia et al. . | |
| 5,022,530 | 6/1991 | Zieke . | |
| 5,033,868 | 7/1991 | Peppiatt . | |
| 5,048,692 | 9/1991 | Handler et al. | 383/61 X |
| 5,053,091 | 10/1991 | Giljam et al. . | |
| 5,056,930 | 10/1991 | Mestetsky | 383/5 |
| 5,063,069 | 11/1991 | Van Erden et al. . | |
| 5,066,444 | 11/1991 | Behr . | |
| 5,092,684 | 3/1992 | Weeks . | |
| 5,094,707 | 3/1992 | Bruno . | |
| 5,100,000 | 3/1992 | Huseman . | |
| 5,102,234 | 4/1992 | Levy | 383/84 X |
| 5,118,202 | 6/1992 | Bruno . | |
| 5,152,613 | 10/1992 | Herrington, Jr. . | |
| 5,186,543 | 2/1993 | Cochran . | |
| 5,192,135 | 3/1993 | Woods et al. . | |
| 5,259,904 | 11/1993 | Ausnit . | |
| 5,309,698 | 5/1994 | Huseman . | |
| 5,366,294 | 11/1994 | Wirth et al. . | |
| 5,372,428 | 12/1994 | Bruno et al. . | |
| 5,382,094 | 1/1995 | Ausnit . | |
| 5,407,277 | 4/1995 | Burke et al. | 383/5 |
| 5,411,692 | 5/1995 | Dipietro et al. . | |
| 5,417,495 | 5/1995 | Branson . | |
| 5,419,437 | 5/1995 | Huseman . | |
| 5,425,216 | 6/1995 | Ausnit . | |
| 5,456,928 | 10/1995 | Hustad et al. | 383/5 X |
| 5,552,202 | 9/1996 | May | 383/204 X |
| 5,875,611 | 3/1999 | Plourde | 383/204 X |
| 6,012,844 | 1/2000 | Huseman et al. | 383/5 X |

PLASTIC BAG WITH TAMPER-EVIDENT CLOSURE

CROSS-REFERENCE TO RELATED APPLICATION

This application claims the benefit of earlier filed U.S. Provisional Patent Application Ser. No. 60/132,881, filed May 5, 1999, which is hereby incorporated herein by reference.

FIELD OF THE INVENTION

The present invention relates generally to containers, and more specifically to a tamper-evident plastic bag.

BACKGROUND OF THE INVENTION

Reclosable plastic bags are used for many purposes, including as biohazard specimen bags for secondary specimen containment in hospitals and laboratories, for storing forensic evidence in law enforcement, and for storing and transporting food and other materials. Reclosable bags are often preferred over other available bags because of numerous advantages, including that they are spill resistant, easy to fill and close, and easy to reopen for access without compromise of integrity when closed.

In the laboratory or hospital setting, a collected specimen of blood, urine, or other biological fluid or tissue is typically first placed in a primary container, such as a tube, vial, or other suitable container, which is then sealed in a biohazard specimen bag for secondary containment, handling, and, if desired, identification. When filled with a specimen, the reclosable biohazard specimen bag is typically sent to a destination remote from the point of collection, such as a pathology laboratory for testing or examination of the specimen.

Conventional biohazard specimen bags typically comprise a reclosable plastic bag with a zip-action, locking reclosable closure that reduces the likelihood of inadvertent compromise or opening, such as from pressure created by changes in the contents. Because of the locking nature of the two interlocking parts or elements of the closure profile, the bag typically will open only if the laboratory worker firmly grasps with both hands the lips of the reclosable bag, created above the reclosable closure means, and pulls them apart in opposite directions using both hands.

There is presently a heightened sensitivity to the protection of laboratory workers, especially in light of the recent identification of numerous viral pathogens for which there presently are no known cure, e.g. HIV, HSV, and Ebola. These concerns have generated many rules and regulations regarding the procedures that testing laboratories must follow in handling biospecimens. Typically, a laboratory worker, often a pathologist or laboratory technician, is required to wear latex or other suitable protective gloves when handling a biohazard specimen bag and/or its contents, as protection against possible infectious agents or pathogens, such as bacteria or virus. The use of protective gloves often presents difficulty in opening the closure of a reclosable bag. Often, gloved persons have difficulty manipulating the bag to grasp the lips above the reclosable closure to permit opening the bag. Also, forceful pulling of the bag's lips may cause sudden opening of the bag and/or tearing along the sides of the bag. As a result, the contents may fall out of the bag, often breaking or damaging the integrity of the primary container, and potentially resulting in contamination of the specimen and/or the laboratory, and attendant risk to laboratory workers.

Because of the difficulty in opening a bag's reclosable closure, and the fact that the bag will likely not be reused in any event, many laboratory workers do not bother opening the reclosable closure. Instead, they may cut the bag to reach its contents. While cutting the bag facilitates reaching the bag's contents, the use of a blade presents another opportunity for health hazards and contamination. The laboratory worker may cut, puncture or injure a hand or finger in the process of cutting the bag; and/or the cutting blade may present a source of cross-contamination between specimens. Perforated bags could permit tearing the bag along a perforation through the bag without opening the reclosable closure means, but perforations are unacceptable or prohibited for many containment purposes, as the presence of perforations can permit air to enter the bag and might also allow contents to spill or leak from the bag. Perforated bags also can permit tampering with the bag's contents more readily than non-perforated bags, as the perforations can present potential paths of access to the bag's interior without substantial visual damage or alteration to the bag. Because of their decreased structural integrity, perforated bags generally are not well-suited for containing biohazardous materials.

In order to insure the integrity of the contents of a reclosable bag, it has been found desirable in many applications that the bags be provided with a tamper evident closure means. For example, forensic evidence can be collected at a crime scene, sealed in a reclosable bag, and stored until needed for laboratory analysis and/or use at trial. In order to later verify that the evidence analyzed by the laboratory or used at trial was the same evidence collected at the crime scene, and was unadulterated prior to its analysis or use at trial, tamper evident closure means are secured and a chain of custody is maintained. Tamper evident closure means are also desirable in other applications, such as secondary containment for the storage and transport of biologic and other materials to be subjected to laboratory analysis at a location remote from the point of collection, to insure that the contents are not contaminated or altered prior to analysis. Tamper evident closures are also advantageous in the storage and transport of food and other products to assist in verification of the container's integrity. Perforations in a tamper evident storage bag are particularly undesirable, as perforations present a pathway for inadvertent contamination or purposeful adulteration of the contents without readily observed alteration of the bag or its tamper evident features.

Thus it can be seen that a need exists for a non-perforated, reclosable bag that permits access to the contents of the bag without the need for opening the reclosable closure means, permitting ease of access, for example, by a person wearing gloves. A further need exists for a bag that provides a tamper-evident closure. It is to the provision of a bag meeting these and other needs that the present invention is primarily directed.

SUMMARY OF THE INVENTION

In one preferred aspect, the present invention comprises a tamper-evident bag having a first wall and a second wall. Each of the first and second walls preferably have a top edge, a bottom edge, and first and second side edges. The bottom and side edges of the first and second walls preferably are joined to define an interior region. The first wall preferably includes a flap extending a distance beyond the top edge of the second wall. The bag preferably also includes a tear zone facilitating detachment of a portion of the bag.

In another preferred aspect, the present invention is a tamper-evident bag having at least one wall bounding an interior region, a mouth communicating with the interior region, a closure provided on at least a portion of the at least one wall, and tamper-evident means for indicating access to the interior region.

In another preferred aspect, the present invention is a tamper-evident bag. The bag preferably includes a first wall having a bottom edge, a top edge, and first and second side edges. The bag preferably also includes a second wall comprising a bottom edge, a top edge, and first and second side edges. The bottom edge and first and second side edges of the second wall are preferably joined to the bottom edge and first and second side edges, respectively, of the first wall, thereby forming an interior region. The bag preferably also includes a first closure element on the first wall. The bag preferably also includes a second closure element on the second wall, adapted to releasably engage the first closure element. The bag preferably also includes a tear zone comprising a section of reduced thickness of at least one of the first and second walls. The bag preferably also includes a flap extending from the first wall, and having an adhesive portion.

In preferred forms, the bag of the present invention satisfies the structural, functional and security requirements of hospitals and laboratories, and forensic evidence storage, without presenting any risk to the user. Moreover, the bag of the present invention reduces the likelihood that the contents will spill due to a gloved user damaging the bag while trying to access the contents, because the user will not have to pull as hard to access the contents of the bag of the present invention as is the case with a conventional reclosable bag.

The plastic bag of the present invention can be made from an extruded plastic bag film web. The bag film web can be cut or otherwise formed into a bag comprising a first wall on which a first closure profile element is disposed and a second wall on which a second closure profile element is disposed. On either wall or both walls, below the closure profile element, the plastic film web can be formed into subsections having different thicknesses. At least one of the subsections is thinner in cross-section, formed of a thinner bag film web, thus creating a "tear zone" that can have a substantially linear, not substantially cross-linked, molecular alignment. A sufficient distance from the centerline of the thin subsection, on either side or both sides of the thin subsection, one or more reinforcing strips can be formed of sufficient mass, weight, or strength to reduce at least partially the lateral forces that might otherwise act in or on the thin section during extrusion to cause unacceptable wrinkling of the thin section and/or surrounding sections.

Because of the "tear zone" of the bag of the present invention, laboratory personnel may be more efficient in opening biohazard bags, which may increase the overall productivity of the laboratory and provide overall operating cost savings. In addition, preferred forms of the bag of the present invention are inexpensive to manufacture, and can be produced in a variety of methods largely making use of standard equipment, further increasing the bag's desirability. The tear zone of the containment portion of the bag does not include any perforations, thereby eliminating or reducing the above-mentioned disadvantages presented by perforated bags.

According to further preferred embodiments, the bag of the present invention can optionally include one or more ribs that contact the outer surfaces of closure profile elements to create at least a partial secondary seal. Such ribs further seal the bag and prevent the contents of the bag from leaking or spilling from the bag, and further prevent the contents from coming into contact with ambient air. The bag of the present invention is preferably a reclosable bag having interengaging closure elements for hermetically sealing the contents in the bag. Less preferably, the bag of the present invention is a non-reclosable bag, which may or may not include a non-reclosable closure.

The present invention also encompasses die assemblies for the manufacture of the bag of the present invention, each die assembly preferably including a suitable protrusion for creating the tear zone. The die assemblies can be included in new extrusion apparatus, or can be adapted or "retrofitted" inexpensively to existing extrusion apparatus. The die assemblies can be made in a multitude of ways to create a section, of at least one wall of the bag, that is thinner than its surrounding sections, thus defining a tear zone. The protrusion can be of a desired depth to form a sufficiently thin section to define a "tear zone" and cause the polymeric material to align in a substantially linear orientation, rather than the substantially cross-linked orientation that may be present in the remainder of the bag film. The thin section of the bag can be created by a protrusion extending into the space between the interior and exterior die plates of the die assembly. The protrusion can extend from and be integral with the interior or exterior die plates, or can be altogether separate in the case of a tangential die plate. The protrusion can be fixed or adjustable, integral or separate, and of any suitable shape. The die assemblies of the present invention are thus extremely flexible.

In the case of adapting or retrofitting existing extrusion apparatus, a single die plate can be changed to produce an inexpensive apparatus adapted to make a previously unavailable reclosable bag. If the manufacturer wishes to change a single die plate in an existing extrusion apparatus, the interior die plate can be modified or replaced to create a protrusion into the space between the die plates, or the exterior die can be changed. The die assemblies of the present invention allow the use of many preexisting die components in the case of existing extrusion apparatus, creating a flexible, inexpensive, and efficient die assembly.

Because there may be unacceptable lateral stresses created in the thin section of polymeric material during extrusion, further preferred forms of the present invention optionally further provide reinforcing strips that can be simultaneously extruded or otherwise formed onto a wall of the bag, a sufficient distance from the centerline of the thin section, to reduce at least partially the lateral stresses that might otherwise cause undesirable wrinkling of the thin section. A strip is preferably of sufficient mass, weight, or strength to reduce the lateral forces acting in the thin section sufficiently, or can be coupled with other strips. A strip can be extruded by a separate extruder or can be formed integrally with the material of the bag by the use of cavities in the die plates.

A strip can be formed in the interior or exterior surfaces of the bag film, can be used to balance the weight of the profile element nearest the thin section, can be formed in balanced pairs, can be integral with the bag film or fused after the bag film is made, and can be formed from the same material as the bag film or from different material. The strips are thus extremely flexible and inexpensive to create. A strip can also be positioned in different places, so long as the lateral forces acting within the thin section of a bag are reduced and unacceptable wrinkling is diminished.

In conjunction with the thin section, the strips can help define the tear zone. Therefore, the strips of the present invention can substantially prevent the user from tearing the bag in such a way as to cause the contents to spill or fall from the bag. The strips of the present invention can, therefore, serve dual functions, initially during the extrusion process, and subsequently during the use of the finished bag by a user wearing gloves.

Of course, a second thin section optionally can also be formed on the surface of the first or second walls. In the case a second thin section is provided, it may be desirable to form the second thin section on the same wall as the first thin section, or on the second wall. If the second thin section is formed on the same wall as the first thin section, there can be multiple tear zones from which the user can chose. If the second thin section is formed on a corresponding section of the second wall, the bag may be easier to tear than with only one thin section.

In preferred embodiments, the present invention provides an inexpensive, efficient, and safe reclosable bag that can be torn open by a user wearing protective gloves. In other preferred aspects, the present invention provides flexible, inexpensive, and efficient die assemblies that can be used to manufacture bags with a tear zone that can be used to open the bag by one wearing protective gloves. In other preferred aspects, the present invention provides die assembly components that can be retrofitted to existing extrusion apparatus. In other preferred aspects, the present invention provides flexible, inexpensive, and efficient methods of manufacture that allow the use of a separate extruder to create at least one strip of sufficient weight, mass, or strength to reduce sufficiently lateral stresses acting in or on a thin section of extruded bag film during extrusion and to prevent substantial, unacceptable wrinkling that may otherwise occur. In other preferred aspects, the present invention provides ribs that can act in concert with the closure profile elements to further seal the contents of the bag from outside exposure, leakage, or spillage.

These and other objects, advantages, and features of the present invention will become apparent upon reading the following specification in conjunction with the accompanying drawing figures. The advantages of the invention will be realized and attained by means of the elements and combinations particularly pointed out in the appended claims. It is to be understood that both the foregoing general description and the following detailed description are exemplary and explanatory of preferred embodiments of the invention, and are not restrictive of the invention, as claimed.

DESCRIPTION OF PREFERRED EMBODIMENTS

The present invention includes novel reclosable plastic bags, plastic bags with tamper-evident features, closure profiles for reclosable bags, die assemblies, and methods of manufacture. Various developments in the reclosable plastic bag art are disclosed by U.S. Pat. No. Re. 28,959, Re. 28,969, Re. 29,208 and Re. 26,991, all of which are hereby incorporated by reference in their entireties for background information.

Figure 9:
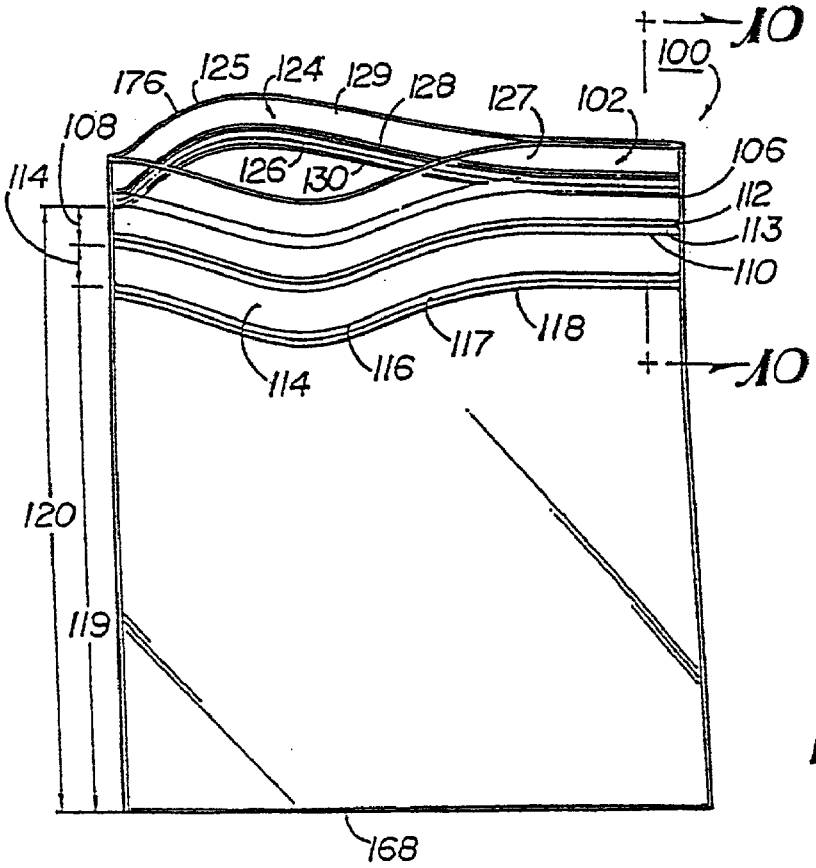
FIG. 9 is a perspective view of one embodiment of a reclosable bag according to a preferred form of the present invention.

FIG. 9 shows a perspective view of a first embodiment of reclosable bag 100 according to the present invention. Bag 100 can be formed from first and second wall panels 102 and 124 in which at least one wall includes a non-perforated thin section 114, thereby creating a "tear zone." Bag 100, if desired, can contain more than two wall panels, such as in instances where double-wall thickness is desired, or when a third wall panel 103 is provided to form a document pouch for holding papers or identifying material 105. Suitable materials from which to form the bags include low density polyethylene, polypropylene, or other suitable polymeric materials. The preferred material is low density polyethylene. In addition to the decreased thickness of thin section 114, the molecular structure of the polymeric resin material can align in a substantially linear fashion in the thin section 114. In the remainder of bag film web 164, the polymeric material can be cross-oriented or bi-oriented. The linear orientation can make the thin section of the wall easier to tear, and can further aid in defining the tear zone. First wall 102 extends to and forms top edge 176, bottom edge 168, and first and second side edges 166 and 170. Lips 127 and 129 are defined between each of the profile elements and top edges 125 and 176 of associated walls 102 and 124. The second wall 124 is similarly configured, having a top, a bottom, and first and second sides. The bottoms and respective first and second sides of the first and second wall panels 102, 124 are joined to form an open-top bag. An openable mouth defined between lips 127, 129 communicates with the interior of the bag. A lower section 120 is defined by the profile element of first wall 102 and bottom edge 168 of first wall 102, wherein the lower section can be formed into first, second, and third subsections, 108, 114, and 119, respectively. The three subsections have first, second, and third thicknesses, respectively, and extend to and from top, bottom, and side edges.

Figure 10:
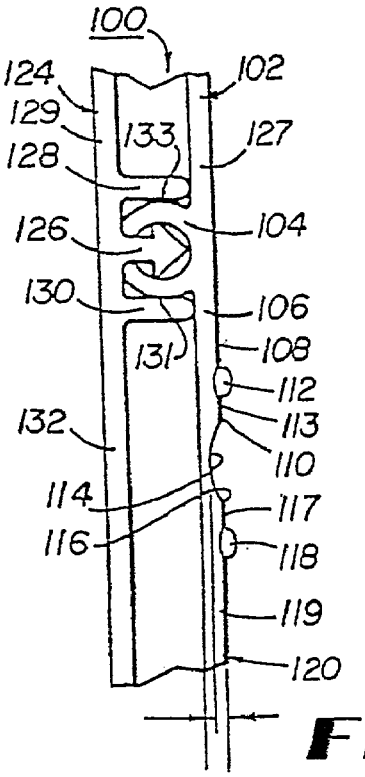
FIG. 10 is a fragmentary cross sectional view of a portion of the bag depicted in FIG. 9 according to a preferred form of the present invention.

FIG. 10 shows a fragmentary cross section view of a portion of a first embodiment of bag 100 of the present invention. Interengaging first and second closure profile elements 104 and 126 are preferably formed on walls 102 and 124 to form a reclosable closure. Lips 127 and 129 are preferably defined between each of profile elements 104 and 126 and top edges 125 and 176 of associated walls 102 and 124. Lower section 120 is defined by the profile element 104 of first wall 102 and bottom edge 168 of first wall 102, wherein the lower section can be formed into first, second, and third subsections, 108, 114, and 119, respectively.

The absolute thicknesses can be varied substantially for different reclosable plastic bag uses, but thin section 114 must be present to define a tear zone without perforations or microperforations that would not be suitable for biohazard material. Although first and third subsections 108 and 119 need not be of the same thickness, the first and third thicknesses should be greater than the second thickness. Thus, the thickness of the thin section 114 is less than adjacent sections of the wall panel 102. In one embodiment, the first and third thicknesses are substantially about 2.5 mils, and the second thickness can be substantially about 2.0 to 1.5 mils, roughly 0.5 to 1.0 mils less than the first thickness. The tear zone preferably extends substantially across the wall panel 102, between the first and second side edges 166, 170.

First subsection 108 is defined by bottom edge 106 of profile 104/126 and top edge 110 of second subsection 114. Third subsection 119 is defined by bottom edge 116 of second subsection 114 and bottom edge 168 of first wall 102. As further discussed below, the reclosable plastic bags of the present invention can have closure profile elements 104 and 126 integral with walls 102 and 124, or profile elements that are fused onto walls 102 and 124 after the bag film web is extruded.

Using any appropriate method for forming reclosable plastic bags, including those discussed below, the present invention involves the creation of a thin second subsection 114 in bag film web 164. Because thin section 114 will have a different weight in the extruding column 215, shown in FIG. 1, lateral stresses created during extrusion may tend to cause thin section 114 to collapse, wrinkle, or buckle in an unacceptable manner, resulting in an unusable product. To compensate for the unbalanced lateral stresses created in thin section 114 during extrusion, one or more reinforcing strips 112 and/or 118 of sufficient mass to reduce such lateral stresses are optionally formed near or adjacent thin section 114.

Figure 11:
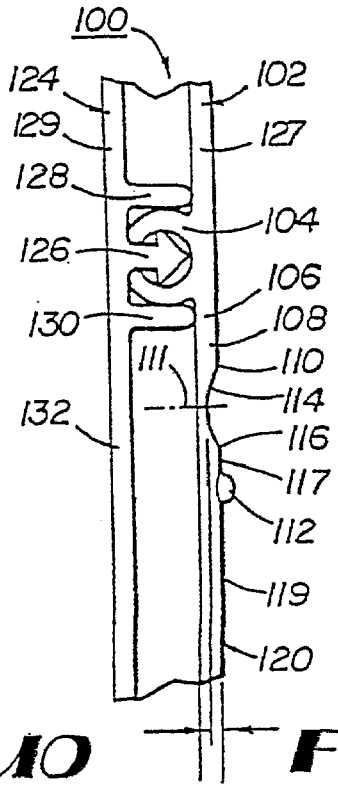
FIG. 11 is a fragmentary cross sectional view of a portion of another embodiment of the reclosable bag according to a preferred form of the present invention.
Figure 12:
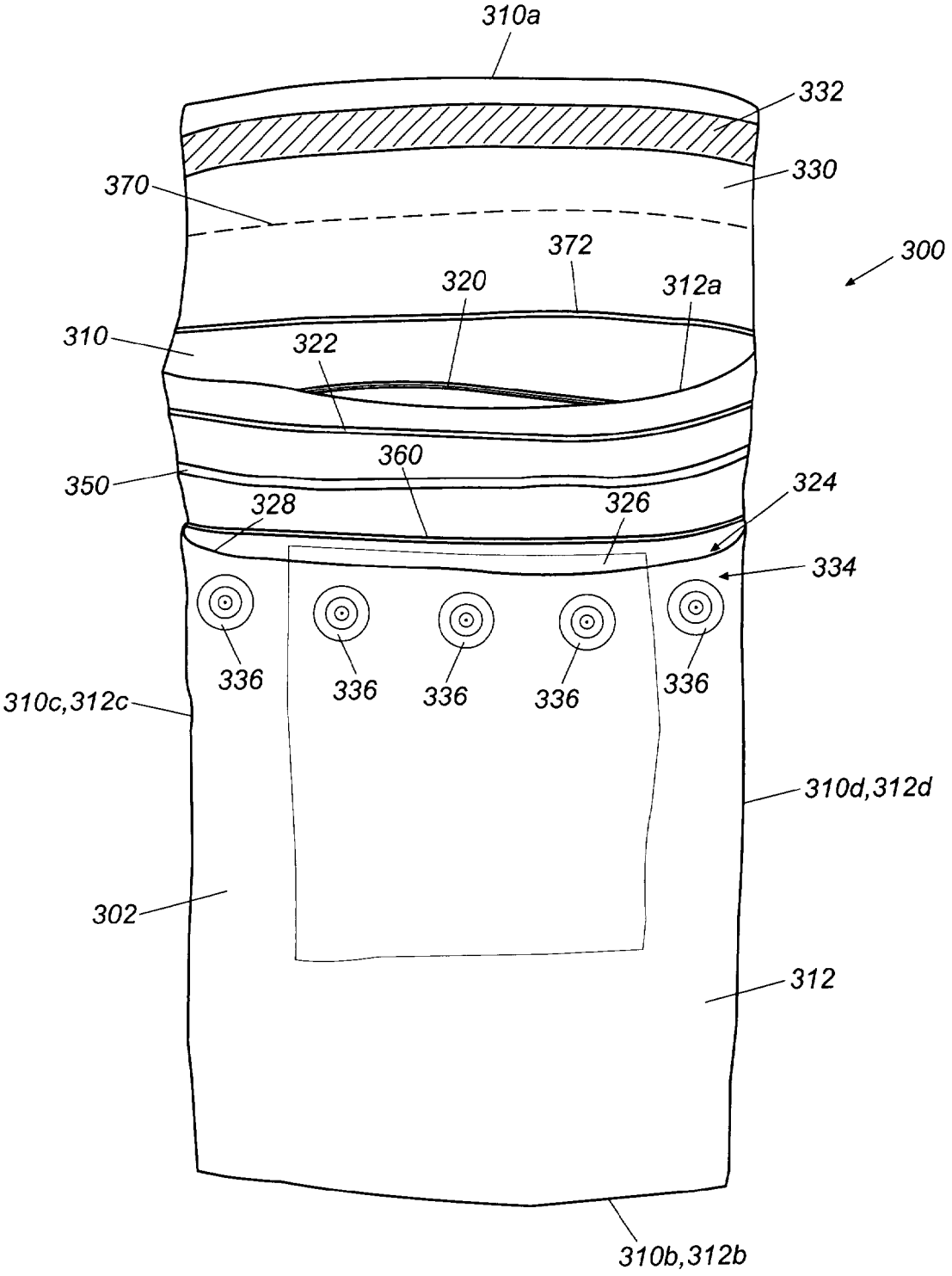
FIG. 12 is a perspective view of a bag according to another preferred form of the present invention, incorporating tamper-evident features.
Figure 13:
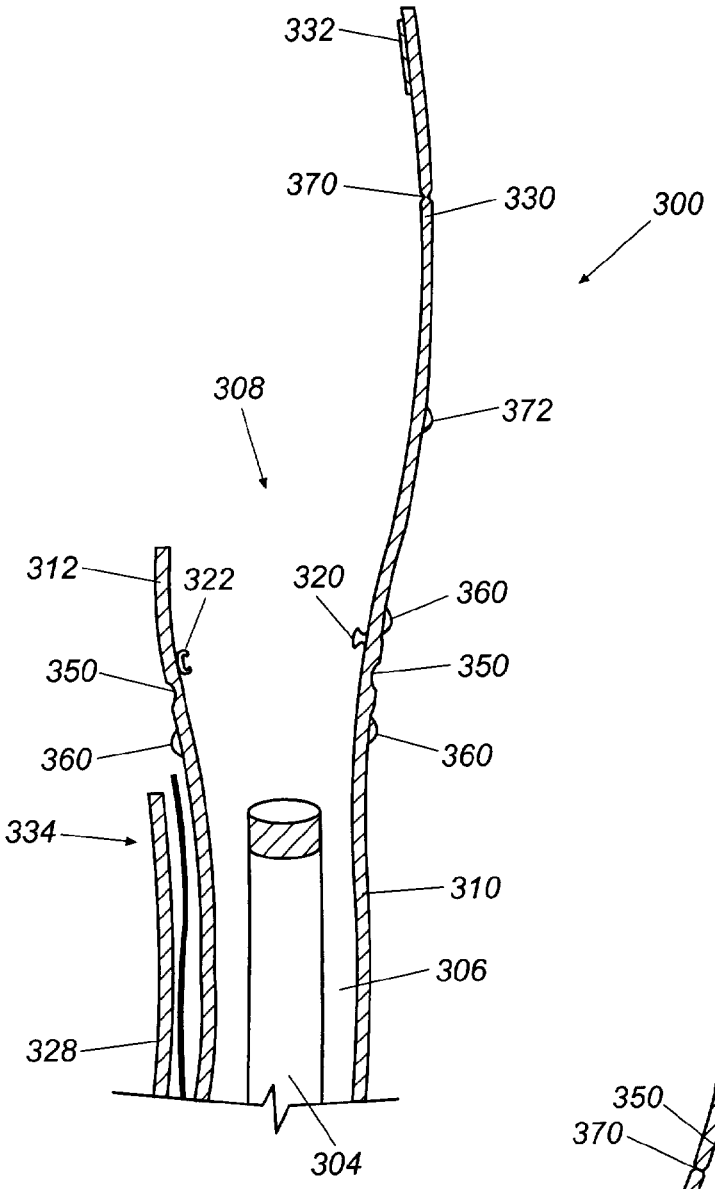
FIG. 13 is cross-sectional side elevational detail of a portion of the bag shown in FIG. 12, depicted in an open configuration.
Figure 14:
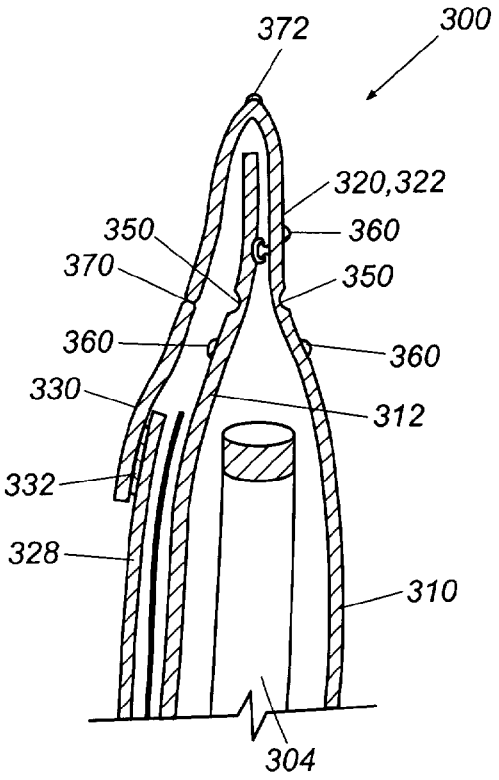
FIG. 14 is cross-sectional side elevational detail of a portion of the bag shown in FIG. 12, depicted in a closed configuration.
Figure 15:
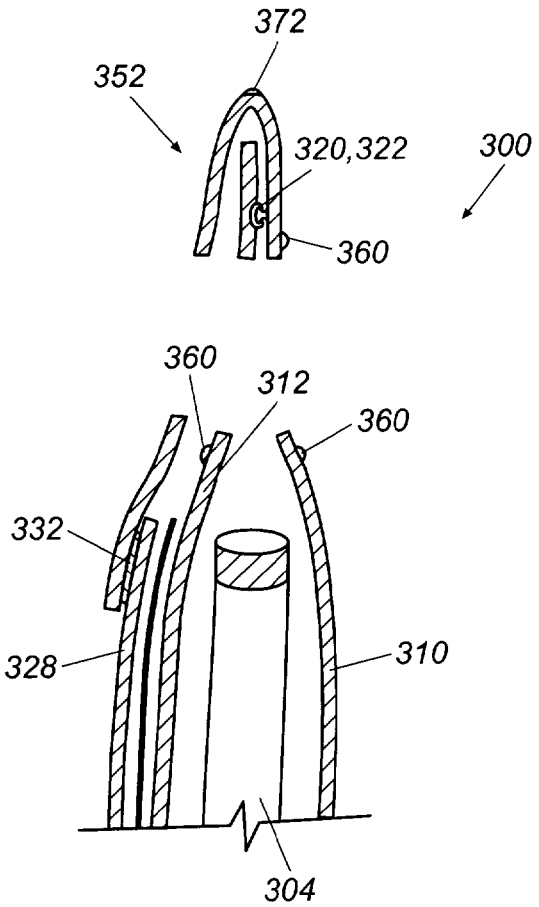
FIG. 15 is a cross-sectional side elevational detail of a bag according to a preferred form of the present invention, having a portion thereof detached.
Figure 16:
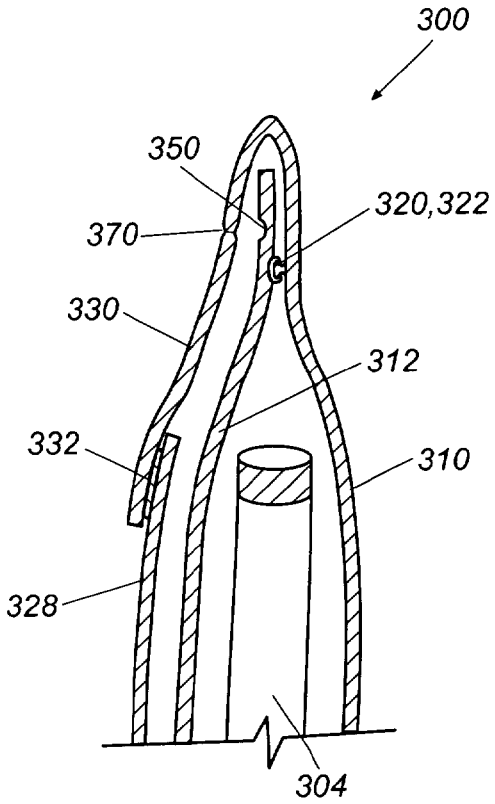
FIG. 16 is cross-sectional side elevational detail of a portion of a bag according to another preferred form of the present invention.

In the embodiment depicted in FIG. 10, strips 112 and 118 can be formed from the same type of polymeric material as the remainder of the bag or from another material of a different density or molecular structure, so long as that second material adheres sufficiently to the first polymeric material. One may desire strips of a different color, and the strips can be provided in that manner. One or more strips provide added weight and strength to thin section 114 and also define the tear zone to some extent. If one is only forming one strip, as depicted in FIG. 11, the closure profile element 104 of associated wall 102 can completely or partially balance the weight and strength of first strip 112. The strip can be lighter or heavier than the closure element, but can simply partially balance its weight and strength. By at least partially balancing the relative masses, weights and strengths of first strip 112 and profile element 104, and the relative distances between first strip 112, closure profile element 104, and centerline 111 of thin section 114, one can adequately to reduce lateral stresses acting in thin section 114. The first strip 112 and the profile element 104 also serve to define the tear zone to some extent.

In the embodiment depicted in FIG. 10, strips 112 and 118 can be formed from the same type of polymeric material as the remainder of the bags or from another material of a different density or molecular structure, so long as that second material adheres to the first polymeric material. Strips 112 and 118 can, of course, themselves be formed of different materials, if desired. Strips 112 and 118 provide added weight and strength to thin section 114 and also define the tear zone to some extent. If one is forming two strips, as depicted in FIG. 10, first strip 112 and second strip 118 can completely or partially balance their respective weights and strengths. By at least partially balancing the relative masses, weights and strengths of first strip 112 and second strip 118, and the relative distances between first strip 112, second strip 118, and centerline 111 of thin section 114, one can adequately to reduce lateral stresses acting in thin section 114 to substantially prevent unacceptable wrinkling of the thin section during extrusion.

Figure 1:
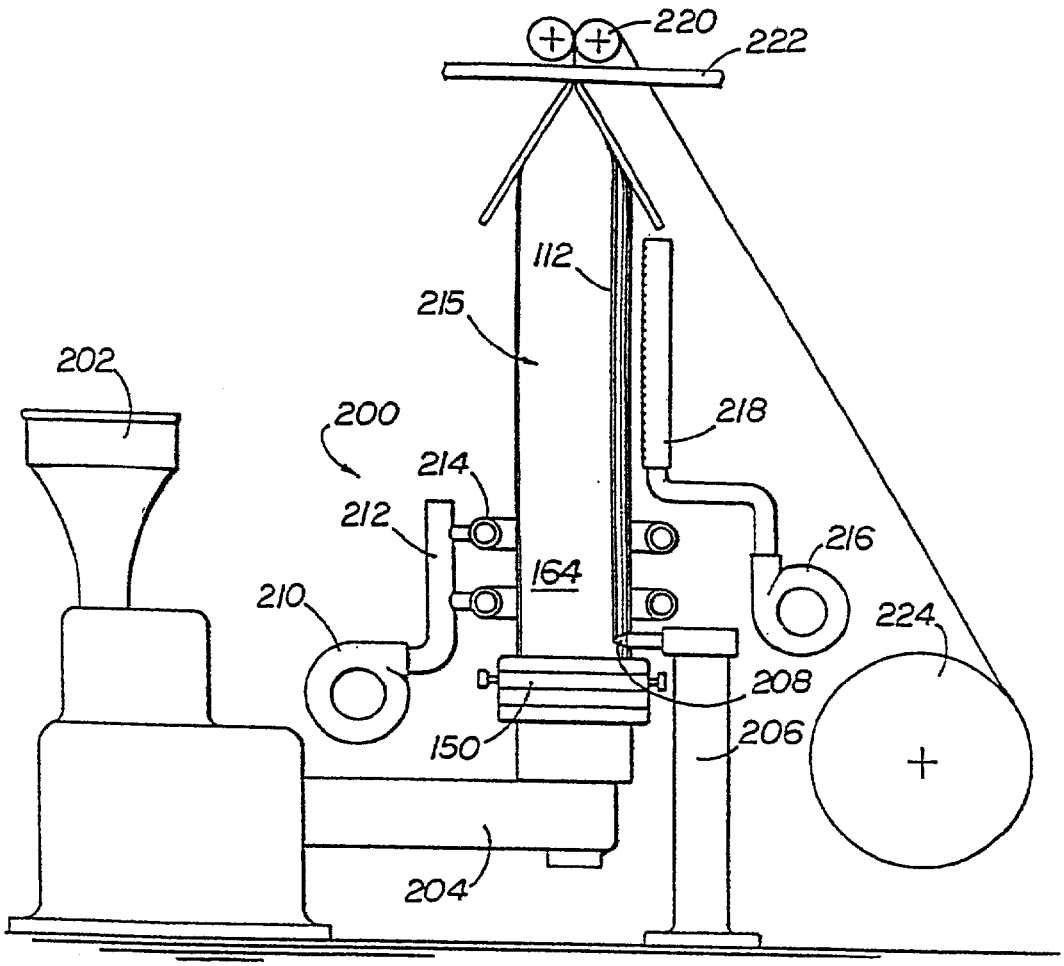
FIG. 1 is a schematicized elevational view of one form of the apparatus for producing bags according to a preferred embodiment of the present invention.
Figure 3:
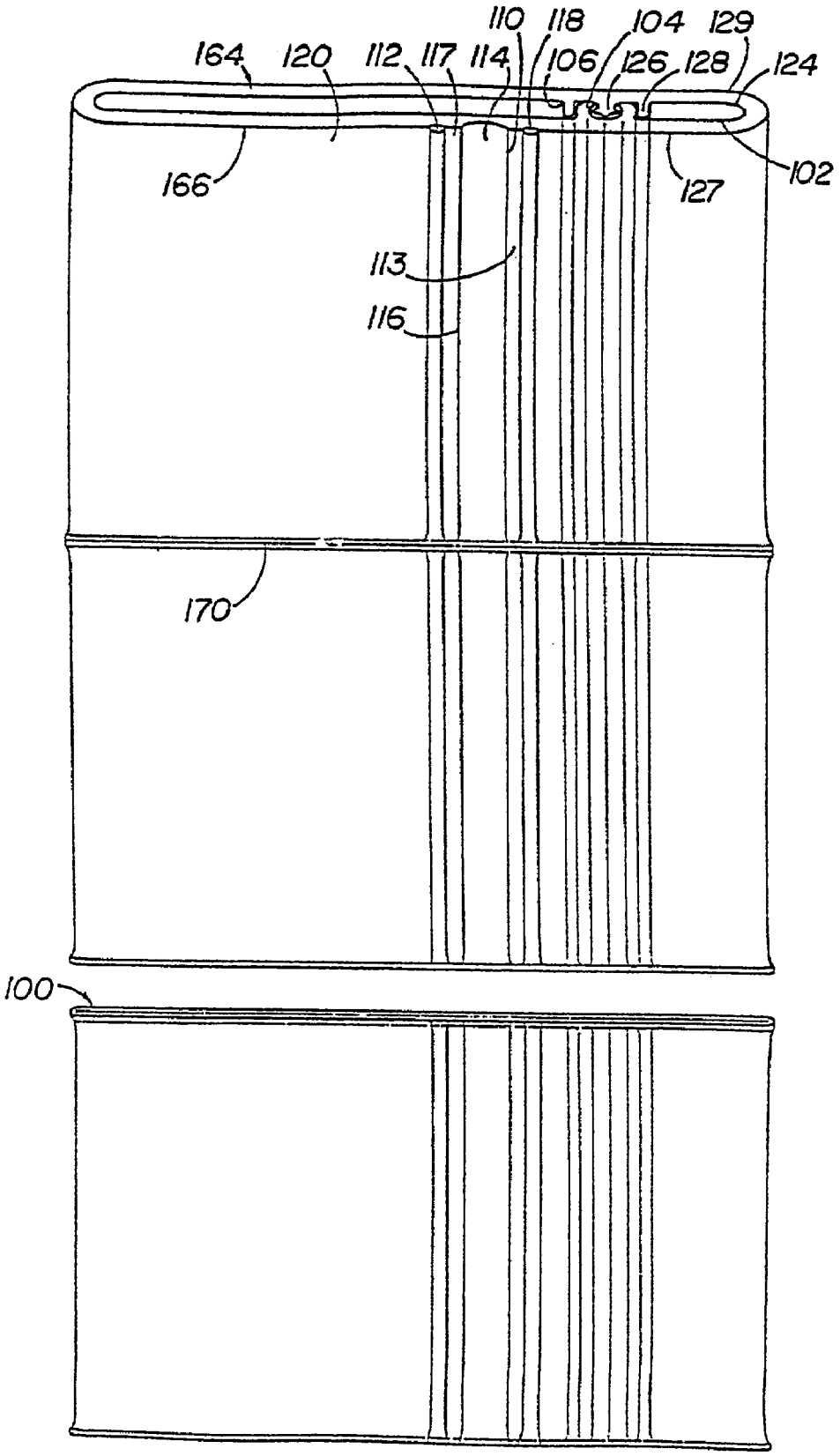
FIG. 3 is a side view of one embodiment of folded, extruded material according to a preferred form of the present invention.

FIG. 1 shows a schematicized elevational view of a first embodiment of an apparatus of the invention. After bag film web 164 has been shaped by die assembly 150, one or more strips can each be extruded from nozzle 208 of extruder(s) 206, for the associated strip, onto outside surface 158 of bag film web 164. The extruded strip should be at a temperature sufficient for the extruded strip substantially to adhere to the bag film web 164. The strips can be extruded onto either or both edges 110 and 116 of second subsection 114, or can be spaced apart from the edges of second subsection 114 by distances 113 and 117 (shown in FIGS. 3, 10, and 11). In the latter embodiment, the strips would actually be on outside surface 158 of first and third subsections 108 and 119 of lower section 120.

Alternatively, first and/or second strips 112 and 118 can be formed integral with the bag film web. First and/or second strips 112 and 118 can be simultaneously extruded with the bag film web on the inside surface 160 or outside surface 158, or alternatively can be formed on the inside surface 160 or outside surface 158 of lower section 120 after the bag film is extruded from space 154. Integral first and second strips 112 and 118 can be formed on the outside surface 158 or inside surface 160 of lower section 120. In addition to the discussed permutations, the disclosed reclosable plastic bag could be also be made with a thin section on lower section 132 of second wall 124 such that the second thin section generally corresponds in dimensions and placement with thin section 114. If a thin section is used on second wall 124, further strips of sufficient mass to reduce lateral stresses acting on the second thin section could be formed on the inside or outside surfaces of second wall 124. Those strips could be extruded onto the outside surface of second wall 124, or could be formed integral with either the inside 160 or outside 158 surfaces of first wall 102 using cavities in the associated component of the die assembly.

It may be possible to make first subsection 108 the thin section. However, there may be a certain amount of thickness inherently produced in walls 102 and 124 proximate and adjacent to closure profile elements 104 and 126 when those elements are extruded integral with bag film web 164. In that case, it may be difficult to avoid having a thicker section immediately adjacent to closure profile elements 104 and 126, and forming thin section 114 lower on lower section 120 may be desirable, after the inherent thickness proximate to elements 104 and 126 decreases to or below the desired first thickness.

In addition to the combination of thin section 114 and first and/or second strips 112 and 118, the present invention includes novel closure profiles. FIGS. 10 and 11 are fragmentary cross sectional views of a portion of bag 100. Conventional, interlocking closure profile elements are fully described in Naito, U.S. Pat. No. Re. 28,969 and Uramoto, Re. 33,674, which are incorporated herein by reference, and include male element 126 and female element 104, both of which are designed and shaped to be interlocking in such a manner that bag 100 can be opened from the outside, while resisting opening from the pressures created by the contents. Of course, it will be understood that the reverse configuration, wherein the first closure element 104 comprises a male element on the first wall panel 102, and the second closure element 126 comprises a female element on the second wall panel 124, is equally within the scope of the present invention.

The present invention uses conventional reclosable closure profiles, as discussed by Naito and Uramoto, and optionally adds one or more ribs 128 or 130 to the closure profile so as to increase the structural integrity and sealing ability of the closure profile. Rib 130 at least partially prevents the contents of bag 100 from coming into contact with closure profile elements 104 and 126, and rib 128 at least partially prevents ambient elements, air, moisture, etc., from contacting closure profile elements 104 and 126.

In a preferred embodiment, rib 130 extends from one wall 124 to contact inside surface 160 of the other wall 102 and lower outside surface 131 of element 104 to form at least a partial seal between rib 130, closure profile element 104, and wall 102. Rib 128 extends from wall 124 to contact the inside surface of wall 102 and upper outside surface 133 of element 104 to form at least a partial seal between rib 128, closure profile element 104 and wall 102. As described below, ribs 128and 130 can be formed integral with bag film web 164 by the creation of further cavities in interior die plate 152, or can be fused in desired positions.

Figure 2:
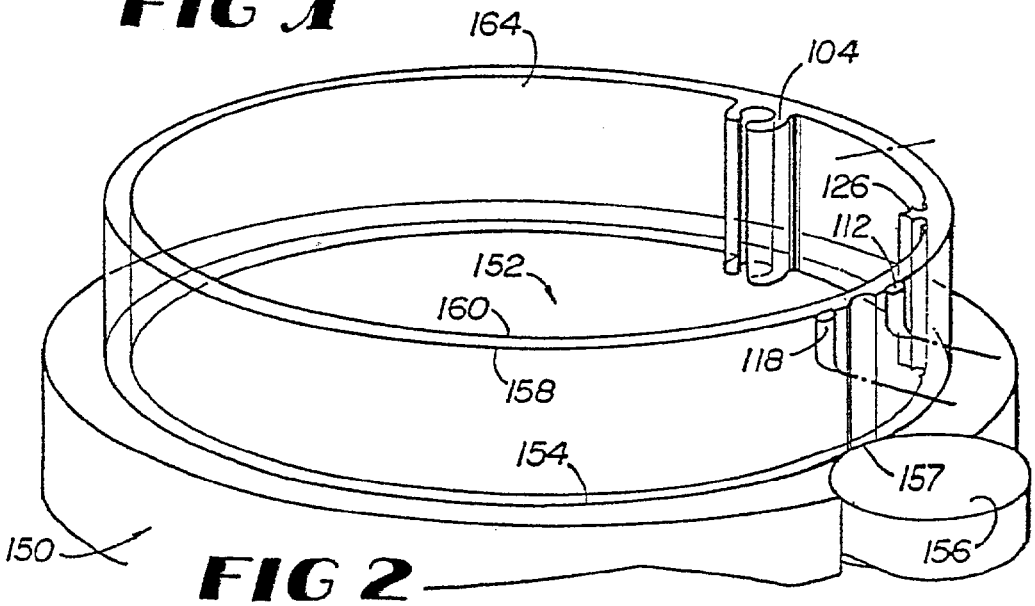
FIG. 2 is a fragmentary perspective view of one embodiment of a die assembly according to a preferred form of the present invention with a portion of material being extruded therefrom.
Figure 4:
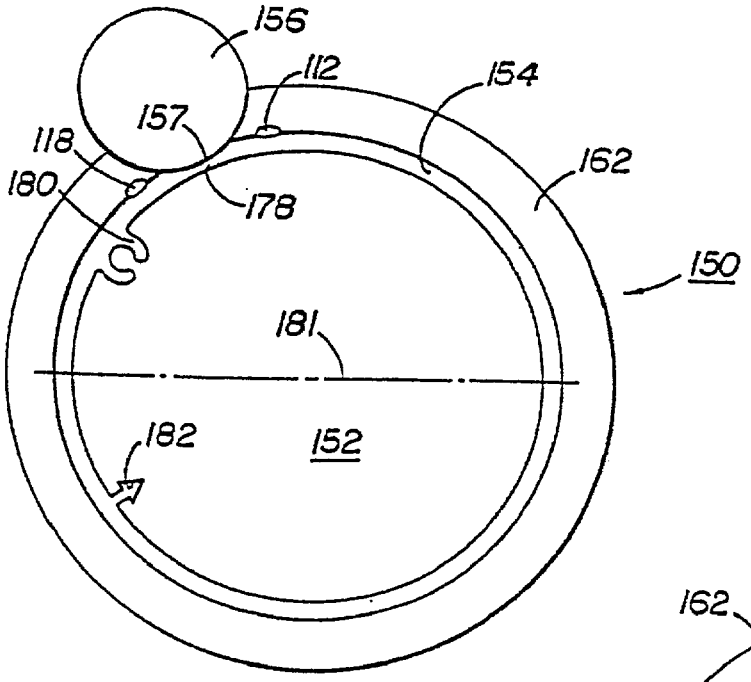
FIG. 4 is a top plan view of one embodiment of a die assembly according to a preferred form of the present invention.

FIG. 2 shows a fragmentary perspective view of one embodiment of a die assembly of the invention with a portion of material being extruded therefrom. Bag film 164 is depicted with closure profile elements 104 and 126 and strips 112 and 118 being extruded on outer surface 158. FIG. 4 shows a top plan view of a first embodiment of a die assemblies of the present invention. Conventional die assemblies for forming reclosable plastic bags are described fully in Naito, U.S. Pat. No. Re. 29, 208 and Geiger and Kain, 4,755,248, which are incorporated herein by reference. The present die assembly uses exterior die 162 and interior die plate 152 to create space 154 between die assembly components 152 and 162. The phrases "die plate" and "die" are used solely for purposes of clarity, can be used interchangeably, and are not intended to distinguish die assembly components absent a qualifier such as "interior," "exterior," or "tangential." The space 154 can be narrowed in section 178 by protrusion 157 which extends into space 154. Narrowed section 178 creates thin section 114 of bag film 164 when the polymeric material is channeled through space 154, thereby creating a tear zone.

Protrusion 157 extends into space 154 from exterior die 162. Protrusion 157 can be integral with interior die plate 152 or exterior die 162, or can be a separate die component, such as tangential die plate 156. Tangential die plate 156 can reside partly within exterior die 162, or can be affixed to the surface of the die component in contact with space 154. Tangential die plate 156 can be fixed or can be adjustable to adjust or optimize the thickness of thin section 114. In the first embodiment of the die assemblies depicted in FIG. 4, strips 112 and 118 are shown, but would be extruded onto the outside surface the bag film after extrusion of the bag film.

Figure 5:
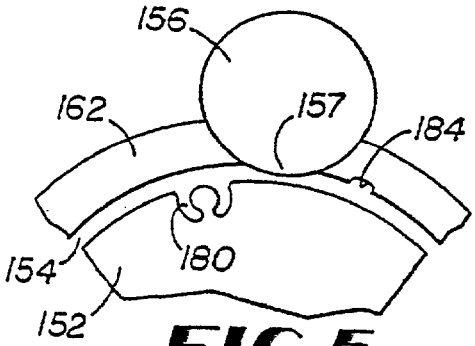
FIG. 5 is a fragmentary top plan view of another embodiment of a die assembly according to a preferred form of the present invention.

FIG. 5 depicts a second embodiment of a die assembly of the present invention. Protrusion 157 extends into space 154 from exterior die 162. Protrusion 157 can be integral with interior die plate 152 or exterior die 162, or can be a separate die component, such as tangential die plate 156. Tangential die plate 156 can reside partly within either of die assembly components 152 or 162, or can be affixed to the surface of either die component in contact with space 154. Tangential die plate 156 can be fixed or can be adjustable to adjust or optimize the thickness of thin section 114. Exterior die 162 also includes a first cavity 184 to form strip 112 integral with outside surface 158 of bag film web 164.

Figure 6:
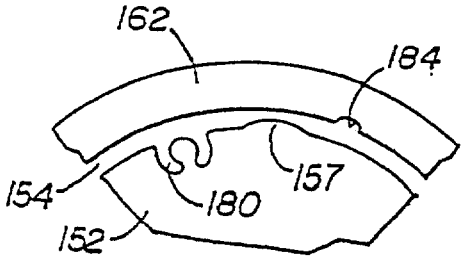
FIG. 6 is a fragmentary top plan view of another embodiment of a die assembly according to a preferred form of the present invention.

FIG. 6 depicts a third embodiment of a die assembly of the present invention. Protrusion 157 extends into space 154 from interior die plate 152. Protrusion 157 can be integral with interior die plate 152, or can be a separate die component, such as a tangential die plate. A tangential die plate can reside partly within die assembly component 152, or can be affixed to the surface of the die component in contact with space 154. Tangential die plate 156 can be fixed or can be adjustable to adjust or optimize the thickness of thin section 114. Exterior die 162 can also include a first cavity 184 to form strip 112 with outside surface 158 of bag film web 164.

Figure 7:
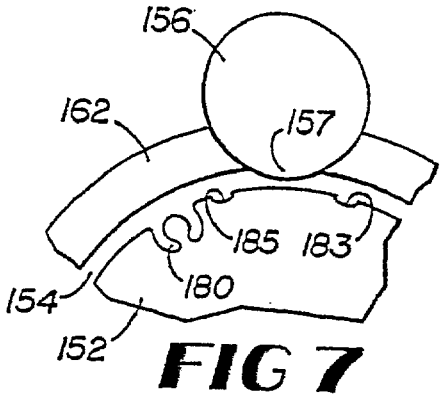
FIG. 7 is a fragmentary top plan view of another embodiment of a die assembly according to a preferred form of the present invention.

FIG. 7 depicts a fourth embodiment of a die assembly of the present invention. Protrusion 157 extends into space 154 from exterior die 162. Protrusion 157 can be integral with exterior die 162, or can be a separate die component, such as tangential die plate 156. Tangential die plate 156 can reside partly within die assembly component 162, or can be affixed to the surface of the die component in contact with space 154. Tangential die plate 156 can be fixed or can be adjustable to adjust or optimize the thickness of thin section 114. Interior die plate 152 can also include third and fourth cavities 183 or 185 to form strips 112 or 118 integral with inside surface 160 of bag film web 164.

Figure 8:
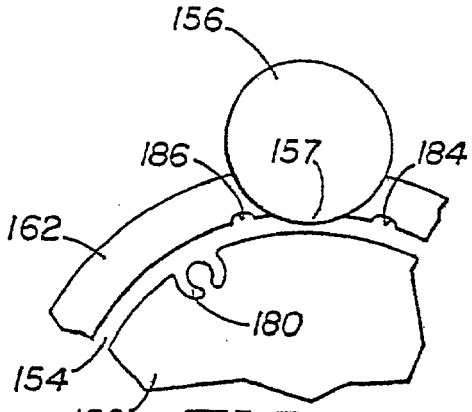
FIG. 8 is a fragmentary top plan view of another embodiment of a die assembly according to a preferred form of the present invention.

FIG. 8 depicts a fifth embodiment of a die assembly of the present invention. Protrusion 157 extends into space 154 from exterior die 162. Protrusion 157 can be integral with exterior die 162, or can be a separate die component, such as tangential die plate 156. Tangential die plate 156 can reside partly within the die assembly component 162, or can be affixed to the surface of either die component in contact with space 154. Tangential die plate 156 can be fixed or can be adjustable to adjust or optimize the thickness of thin section 114. Exterior die 162 can also include first and second cavities 184 or 186 to form strips 112 or 118 integral with outside surface 158 of bag film web 164.

As depicted in FIGS. 4 through 8, there are numerous variations and combinations of die assembly components and cavities. In all cases, the interior or exterior die components can be formed to create a protrusion that will produce the desired tear zone in the bag film to allow a user to access the contents without opening the closure means. Alternatively, separate die components can be fixed, either permanently or adjustably, within either the interior or exterior die components to create a protrusion that will produce the desired tear zone in the bag film. Also as depicted in FIGS. 4 through 8, there are numerous variations and combinations of cavities that can be formed in the interior or exterior die components to form strips of sufficient weight, strength, or mass to reduce sufficiently lateral forces that can act in the thin section during extrusion. The strips can reduce the lateral forces sufficiently to allow extrusion substantially without lateral forces that can otherwise cause undesirable wrinkling in the thin section.

Several fundamental approaches for forming conventional reclosable bags are described in the patent literature. One approach has been to form the bag film web and the closure profiles in a single extrusion operation. See Ausnit, U.S. Pat. Nos. 3,338,284; Behr, 3,852,386; and Naito, Re. 29,208.

A second approach uses an adhesive, such as a strip of tape or glue, to join a closure profile to a bag film web. For example, Ausnit U.S. Pat. No. 4,101,355 discloses a reclosable bag film forming process in which a web and closure profile are joined by a liquid adhesive supplied by an applicator having a nozzle. After the adhesive is applied, the web and closure profiles are pressed together by a presser roll and a backing roll. See also Ausnit, U.S. Pat. No. 3,226,787.

A third approach involves the use of a pre-formed bag film web and a preformed closure profile which are drawn from separate stock rolls. The bag film web and/or closure member are then heated and joined. For example, Howard, U.S. Pat. No. 3,846,209 discloses a method for producing a bag film containing a closure profile wherein a preformed plastic film can be fed from a stock roll into a sealing station. A separate closure strip from a second stock roll can be also fed into the sealing station. In the sealing station, the closure strip and plastic film are welded together by a pair of heating bars.

A fourth approach involves the use of a pre-formed bag film web drawn from a supply roll and joined to a relatively freshly extruded closure profile. For example, Noguchi, U.S. Pat. No. 3,904,468 discloses a method of making a reclosable bag film in which a web of bag film material can be unwound from a stock roll and then transferred to a heating station having a heating roll on which the film can be heated to a desired temperature. The film is then transferred to a heated joining roll at which the film is joined to the freshly extruded fastener profile strips. See also Takahashi, U.S. Pat. No. 4,279,677; and Ferrell, 4,582,549.

Yano, U.S. Pat. No. 4,555,282, discloses another variation of the fourth approach. Yano discloses a method of bonding a closure profile to a bag film web in which a closure profile having a base portion and a fastener profile portion can be extruded shortly before being bonded to a bag film web. Between the extrusion of the closure profile and its joinder to the bag film web, only the fastener profile portion is cooled, thereby solidifying and stabilizing. The base portion of the profile is left heated, thereby remaining thermoplastic, when the closure profile is joined to the film. Kamp, U.S. Pat. No. 4,306,924, discloses another variation on the fourth approach in which the film web is extruded on to a casting roll to join an already formed closure profile.

A fifth approach involves extruding a bag film web and a closure profile in close proximity to each other and joining them to each other shortly after extrusion. For example, Kamp U.S. Pat. No. 4,428,788 discloses a method for forming a reclosable bag wherein a film, a tape, and a closure profile are extruded by three separate dies. The film, tape, and closure profile dies are positioned so that the film, tape, and closure profiles contact each other while still at a temperature of above 200 degree(s) F. A chill roll can be provided for cooling the film, tape, and closure profiles.

Sutrina et al, U.S. Pat. No. 4,295,915, discloses an apparatus for forming a reclosable bag film wherein a fastener profile and its base strip are extruded integrally, and then joined to a film web. The die for extruding the bag film web may be disposed adjacent to the fastener die block so that the fastener profile and bag film are joined shortly after both are extruded. See also Goto, U.S. Pat. Nos. 3,462,332 and Zieke, 4,522,678.

Although the discussed patents disclose numerous fundamental methods for forming reclosable bags, and reclosable closure means, there is still room for improvement in the art, and the present improvements are intended to be suitable with any of the methods. It may be possible to use many fundamental methods, to modify or adapt them, and to incorporate the novel aspects of the methods disclosed below.

As discussed above, FIG. 1 is a schematicized elevational view of one embodiment of the apparatus of the invention. As depicted in that apparatus, the preferred method involves supplying polymeric resin material into hopper 202 to be heated and fed into the inlet port of an extruder 200. Any suitable polymeric resin material can be used, and, in the preferred embodiment, the material used can be low density polyethylene. The extruder includes a means that causes the heated polymeric material to travel through the space in die assembly 150 to form bag film web 164. As the polymeric material is channeled into the space, air pressure can be created in the lumen of the extruded tube of bag film web 164 by blowing air from the die assembly 150 into the lumen. That air pressure can help to prevent the heated bag film web 164 from collapsing and having the side walls fuse with each other.

Because the thin section of bag film web 164 will have a different weight in the extruding column 215, lateral stresses created during extrusion can tend to cause the thin section at least partially to collapse, wrinkle, or buckle, resulting in an unusable product. To compensate at least partially for the unbalanced lateral stresses imposed on the thin section during extrusion, one or more strips of sufficient mass to reduce such lateral stresses can be formed on a surface of the bag film web 164, preferably sufficiently near the thin section to aid in the reduction of lateral forces acting thereon. One or more strips can provide added weight and strength to the thin section.

Without undue experimentation, it is possible to determine whether one, two, or more strips would be appropriate. One could, therefore, compensate and optimize the system for, inter alia, particular extruding apparatus, different fundamental methods of manufacture, and variations in polymeric material being used.

After bag film web 164 has been shaped by die assembly 150, one or more strips can each be extruded from nozzle 208 of extruder(s) 206 for the associated strip onto outside surface 158 of bag film web 164. The extruded strip should be at a temperature sufficient for the extruded strip substantially to adhere to the bag film web 164.

The bag film web 164, now in the form of a tube, can then be moved through a pinch roller, such as 220 in FIG. 1, and then rolled onto a spool, such as 224 in FIG. 1, and fed into an apparatus designed for making bags from bag film web 164. One embodiment of a bag making apparatus involves the use of a hot knife that cuts bag film web 164 and seals reclosable plastic bag 100 to create side wall edges 166 and 170, depicted in FIG. 3. When the hot knife contacts side wall edge 166 of thin section 114, the decreased mass and heat absorbing ability of thin section 114 can result in a concave notch being created in thin section 114. That notch can also facilitate tearing.

The present method of manufacture discloses numerous combinations and placements of strips proximate to thin section 114 to reduce sufficiently the lateral forces acting in thin section 114 during extrusion. Without undue experimentation, it is possible to implement the present invention to create a wide variety of reclosable plastic bags.

In use, contents are placed into the bag through the mouth, and the first and second closure elements are engaged to close and seal the bag. In order to remove the contents from the bag, a portion of the bag comprising the first and second closure elements is detached from the remainder of the bag by tearing through the tear zone. The tear zone provides a controlled removal of the detached portion, and facilitates removal of the bag's contents even by gloved users.

A particularly preferred embodiment of the present invention is depicted in alternative embodiments by FIGS. 12–16, and will now be described in detail. Except as set out below, the above description of the construction of the bag, the example dimensions and material thicknesses, the methods and materials of its fabrication, and the methods and particular applications of its use, are generally applicable to this form of the invention. As seen with reference to the drawing FIGS. 12–16, the invention preferably comprises a tamper-evident bag 300 having a containment portion 302 for receiving contents 304 such as, for example, forensic evidence, biologic materials, laboratory specimens, food products, or other materials. The bag 300 preferably comprises at least one wall bounding an interior region 306, and a mouth 308 communicating with the interior region. More preferably, first and second walls 310, 312 are provided, each having a top edge 310*a*, 312*a*, a bottom edge 310*b*, 312*b*, a first side edge 310*c*, 312*c*, and a second side edge 310*d*, 312*d*. The bottom edges 310*b*, 312*b*, first side edges 310*c*, 312*c*, and second side edges 310*d*, 312*d* of the first and second walls 310, 312 are preferably joined to form the interior region 306, and the top edges 310*a*, 312*a* remain free to define a generally open mouth 308. Although two walls 310, 312 are shown, the invention also encompasses bags 300 comprising a single wall closed upon itself in the form of a sleeve, and bags 300 comprising three or more walls joined to enclose an interior region.

The bag 300 preferably further comprises a closure provided on at least a portion of the at least one wall. According to a preferred form, the closure comprises a reclosable closure such as, for example, a zip-type closure comprising a male closure element and a female closure element substantially as described in greater detail above. A first closure element 320 is preferably provided on the first wall 310, and a second closure element 322 adapted to releasably engage the first closure element is preferably provided on the second wall 312. The second closure element 322 is preferably located adjacent the top edge 312*a* of the second wall 312, and the first closure element 320 is preferably located in a position on the first wall 310 generally aligned with the second closure element. The first and second closure elements 320, 322 can be integrally formed with the first and second walls 310, 312, or can be separately formed and attached by adhesive, welding, or other attachment means. The first closure element 320 can comprise, for example, a male closure element or a female closure element, and the second closure element 322 can comprise the other. In alternate embodiments, the closure can comprise other types of releasable closures such as releasable adhesive, or can comprise non-releasable closures such as non-releasable adhesive, or can be omitted. The closure preferably forms a hermetic seal preventing entry of contaminants into the interior region 306 and/or preventing inadvertant discharge from the interior region. The walls 310, 312 surrounding the interior region 306, bounded by the bottom edges 310*b*, 312*b*, the first and second side edges 310*c*, 312*c*, 310*d*, 312*d*, and the first and second closure elements 320, 322 are preferably continuous and uninterrupted, also to prevent entry of contaminants into the interior region 306 and/or prevent inadvertant discharge of the contents 304 from the interior region.

A pouch 324 can optionally be provided for receiving documentation 326 or other materials for identification, informational, or other purposes. The pouch 324 is preferably formed between one of the first or second walls 310, 312, and a pouch panel 328. The pouch panel 328 can be integrally formed with the remainder of the bag 300, or can be formed separately and attached to the first and/or second wall 310,312, as by adhesive, thermal or solvent welding or other attachment means.

The bag 300 preferably further comprises tamper-evident means for indicating access to the interior region. In a preferred form, the tamper-evident means comprises a flap 330 extending from the first wall 310 a distance beyond the top edge 312*a* of the second wall 312. The flap 330 preferably extends across substantially the entire width of the bag 300, whereby the flap can be folded over to cover the mouth 308 substantially and prevent access to the interior region 306 of the bag. The flap 330 preferably comprises an adhesive portion 332, preferably located adjacent the free end thereof. The adhesive portion 332 can comprise, for example, a pressure-sensitive adhesive such as double-sided tape, and can be covered with a removable contact sheet to prevent inadvertent adhesion. The flap 330 is foldable between an open configuration, shown in FIGS. 12 and 13, and a closed configuration, shown in FIGS. 14 and 16. In its open configuration, the flap 330 does not obstruct access to the interior region 306 of the bag 300, and the mouth 308 can be opened and closed and the first and second closure elements 320, 322 engaged and disengaged. In the closed position, the adhesive portion 332 is adhered to a contact portion 334 of the bag 300, whereby the flap 330 blocks access to the mouth 308, preventing or rendering substantially difficult the introduction or removal of materials to or from the interior region 306, and preventing or rendering substantially difficult the disengagement of the first and second closure elements 320, 322. The adhesive 332 preferably adheres strongly to the contact portion 334, whereby attempts to detach the adhesive portion therefrom, or to open the closure or otherwise tamper with the contents of the bag will result in plainly observable damage or alteration of the bag, indicating potential tampering. The contact portion 334 is preferably a surface of the second wall 312 and/or a surface of the pouch panel 328. If the contact portion is a surface of the pouch panel 328, documentation 326 will be maintained in the pouch 324 in a tamper-evident manner. If the contact portion is a surface of the second wall 312, documentation 326 can be accessed for removal and replacement to and from the pouch 324 without interference by the tamper-evident means of the bag 300. In alternate embodiments, the adhesive portion or strip 332 can be provided on a surface of the second wall 312 and/or a surface of the pouch panel 328, and the contact portion 334 can comprise a surface of the flap 330.

In further preferred embodiments, the contact portion 334 optionally comprises indicia 336, such as for example a printed or embossed design, which facilitates easier observation of tampering by attempted or actual detachment of the adhesive portion 332 of the flap 330 from the contact portion 334. For example, detachment of the adhesive portion 332 from a printed design provided on the contact portion 334 will result in removal of at least a portion of the ink or other material forming the design from the contact portion. The provision of indicia 336 comprising an intricate, regular pattern, such as for example a bulls-eye pattern or cross-hatching, will more readily indicate tampering.

Preferably, the bag 300 of the present invention optionally comprises one or more tear zones for facilitating access to the contents 304 of the bag, as for example by a gloved user. According to preferred forms of the invention, the tear zone comprises a thin section of one or more of the walls 310, 312 of the bag 300. The thin section, also referred to herein as a section of reduced thickness 350, has a reduced thickness relative to an adjacent region of the bag 300, and is substantially similar in fabrication and structure to the thin section 114 described above. The section of reduced thickness 350 presents less resistance to tearing than adjacent sections of the bag, and creates a localized stress concentration upon application of force thereto. In this manner, the provision of a tear zone enables a user to more readily separate a detached portion 352 from the remainder of the bag, as seen with reference to FIG. 15, without unduly damaging the remainder of the bag or potentially spilling its contents 304. As seen with reference to FIGS. 13 and 14, both the first and second walls can be provided with a section of reduced thickness 350, or alternatively, as seen with reference to FIG. 16, only a single wall can be provided with a section of reduced thickness 350. The section(s) of reduced thickness 350 preferably form a continuous and intact portion of the wall 310, 312, and do not present openings or passages that could permit introduction or removal of material from the interior region 306 of the bag 300, or contamination of the contents 304, as could result from the provision of perforations.

One or more tear zones can be provided to the bag 300, and can be located above (FIG. 16) and/or below (FIGS. 13–15) the closure of the bag. For example, one or more walls 310, 312 of the bag 300 can be provided with a section of reduced thickness 350 between the closure element 320, 322 and the bottom edge 310*b*, 312*b*, such that the closure is removed from the bag with the detached portion 352, thereby enabling direct access to the contents 304 of the bag. This arrangement may be more suitable for use with laboratory specimen bags or other applications wherein reclosure of the bag is not typically necessary or desired after opening. Alternatively, one or more walls 310, 312 of the bag 300 can be provided with a section of reduced thickness 350 between the closure element 320, 322 and the top edge 310*a*, 312*a*, such that the closure is not removed from the bag with the detached portion 352, thereby requiring that the closure be opened to access the contents 304 of the bag. This arrangement may be more suitable for use with forensic evidence bags or other applications wherein reclosure and resealing of the bag may be desired after opening.

As described in greater detail above, each tear zone of the bag 300 can optionally further comprise one or more reinforcing strips 360 adjacent the section of reduced thickness 350 to reduce wrinkling or unbalanced stresses potentially resulting from the provision of the section of reduced thickness 350, and/or to assist in defining the tear zone and to provide more consistent and controlled removal of the detached portion 352 from the remainder of the bag. In exemplary embodiments, and as seen with reference to the first wall 310 of the bag 300 depicted in FIGS. 13–15, first and second reinforcing strips 360 can be provided, with the section of reduced thickness 350 located therebetween. Alternatively, and as seen with reference to the second wall 312 of the bag 300 depicted in FIGS. 13–15, a single reinforcing strip 360 can be provided. Preferably, the section of reduced thickness 350 is located between the single reinforcing strip and a closure element, as depicted, whereby the closure element and the reinforcing strip bound and define the tear zone.

According to a further preferred and optional form of the invention, the tamper-evident means cooperates to assist in defining the tear zone of the bag. For example, the flap 330 can be provided with a perforation, score line, section of reduced thickness relative to an adjacent section of the flap, or other discontinuity 370 presenting a reduced resistance to tearing and/or a stress concentration. Because the flap 330 does not function to provide containment or a barrier to contamination of the contents in preferred embodiments of the present invention, but rather, inhibits and/or indicates tampering, it is not necessary that material of the wall at the discontinuity 370 be continuous and intact. Therefore, the discontinuity 370 can take the form of a perforation through the flap 330. The discontinuity 370 preferably is positioned to align with the section of reduced thickness 350 when the flap 330 is closed and the adhesive 332 affixed to the contact portion 334. In this manner, the discontinuity 370 and the section(s) of reduced thickness 350 cooperate to define an aligned tear zone through the walls 310, 312, and the flap 330. A preformed fold line 372 can be provided, as by printing, coextrusion, perforation, material alteration, or affixing a bead of material to the first wall 310 at the base of the flap 330, to define a line of folding of the flap 330 into a closed position wherein the discontinuity 370 and the section(s) of reduced thickness 350 are aligned. The fold line 372 is preferably approximately equidistant from the discontinuity 370 and the section(s) of reduced thickness 350, whereby in the closed position (see FIGS. 14 and 16), the discontinuity 370 substantially overlies the section(s) of reduced thickness 350.

The bag 300 is preferably fabricated from plastic or other flexible material(s), most preferably a substantially transparent plastic film or sheet material. The bag 300 is preferably formed by extrusion or by other known bag forming methods, substantially as discussed above. For example, the bag 300 can be fabricated using a manufacturing system and apparatus, extrusion dies, and related components substantially as described above.

In a preferred method of use, contents 304 are deposited in the interior region 306 of the bag 300. The closure is releasably sealed by engaging the first and second closure elements 320, 322. Additional contents 304 can be deposited, or deposited contents can be removed from the interior region 306 by selectively opening and resealing the first and second closure elements 320, 322. Any desired documentation 326 is inserted in the pouch 324. Upon completion of loading contents 304 into the bag 300 and closing and sealing the closure, the flap 330 is folded over into the closed position, and the adhesive portion 332 is affixed to the contact portion 334. Subsequent attempts to access the contents 304 or open the closure will alter the indicia 336 or will otherwise evidence tampering. When it is desired to open the bag 300 to access the contents 304, a portion 352 of the bag 300 is detached by tearing through the tear zone. If the closure remains with the bag 300, rather than being detached with the detached portion 352, the closure can be selectively opened and closed as desired to access and re-seal the contents 304 within the interior region 306.

Throughout the specification, various references are identified, each of which is hereby incorporated herein by reference in its entirety for additional background information.

While the invention has been disclosed in preferred forms, it will be apparent to those skilled in the art that many modifications, additions, and deletions may be made therein without departing from the spirit and scope of the invention as set forth in the following claims.

What is claimed is:

1. A tamper-evident reclosable bag comprising a first wall comprising a first closure element and a second wall comprising a second closure element adapted to releasably engage said first closure element, each of said first and second walls having a top edge, a bottom edge, and first and second side edges, wherein said bottom edges and said side edges of said first and second walls are joined to define an interior region, said first wall comprising a flap extending a distance beyond said top edge of said second wall, and said bag further comprising a tear zone facilitating detachment of a portion of said bag, wherein said tear zone comprises a section of reduced thickness relative to an adjacent region formed in at least one of said first and second walls.

2. The tamper-evident bag of claim 1, wherein said flap comprises a preformed fold line and a discontinuity, and wherein said preformed foldline is approximately equidistant from said discontinuity and said section of reduced thickness.

3. The tamper-evident bag of claim 1, further comprising an adhesive portion for attachment with a contact portion to retain said flap in a closed position.

4. The tamper-evident bag of claim 3, further comprising indicia on said contact portion for indicating detachment of said adhesive portion therefrom.

5. The tamper-evident bag of claim 1, further comprising at least one reinforcing strip adjacent to said section of reduced thickness.

6. The tamper-evident bag of claim 1, wherein said tear zone comprises first and second reinforcing strips, and wherein said section of reduced thickness is located between said first and second reinforcing strips.

7. The tamper-evident bag of claim 1, wherein said tear zone is defined by said section of reduced thickness located between a first reinforcing strip and a closure element.

8. The tamper-evident bag of claim 1, wherein said flap is foldable between an open position and a closed position.

9. The tamper-evident bag of claim 8, wherein said flap comprises an adhesive strip for affixing said flap to a contact portion of the bag in the closed position.

10. The tamper-evident bag of claim 9, further comprising indicia on said contact portion for indicating detachment of said adhesive therefrom.

11. The tamper-evident bag of claim 9, wherein at least a portion of said at least one wall comprises a tear zone facilitating detachment of a portion of said bag.

12. The tamper-evident bag of claim 9, wherein said flap comprises a perforation adapted to align with said section of reduced thickness when said adhesive portion is attached to said contact portion of said bag.

13. The tamper-evident bag of claim 1, wherein said tear zone is positioned between said closure element and said bottom edge of at least one of said first and second walls.

14. The tamper-evident bag of claim 1, wherein said tear zone is positioned between said closure element and said top edge of at least one of said first and second walls.

15. The tamper-evident bag of claim 1, comprising first and second reinforcing strips, wherein said section of reduced thickness is positioned between said first and second reinforcing strips.

16. The tamper-evident bag of claim 1, wherein said tear zone is defined by said section of reduced thickness arranged between a first reinforcing strip and said closure elements.

17. The tamper-evident bag of claim 1, wherein said first and second closure elements are integral with said first and second walls.

18. The tamper-evident bag of claim 1, wherein said tear zone is not perforated.

19. A tamper-evident reclosable bag, comprising:

a first wall comprising a bottom edge, a top edge, and first and second side edges;

a second wall comprising a bottom edge, a top edge, and first and second side edges, said bottom edge and said first and second side edges of said second wall being joined to said bottom edge and said first and second side edges, respectively, of said first wall, thereby forming an interior region;

a first closure element on said first wall;

a second closure element on said second wall, said second closure element being adapted to releasably engage said first closure element;

a tear zone comprising a section of reduced thickness of at least one of said first and second walls; and a flap extending from said first wall, said flap comprising an adhesive portion.

20. The tamper-evident bag of claim 19, further comprising a pouch formed between a pouch panel and at least one of said first and second walls.

21. The tamper-evident bag of claim 19, wherein said flap comprises a perforation adapted to align with said section of reduced thickness when said adhesive portion is attached to a contact portion of said second wall.

22. The tamper-evident bag of claim 19, wherein said first and second closure elements are integral with said first and second walls.

23. The tamper-evident bag of claim 22, wherein said first and second closure elements are formed by extrusion.

24. A tamper-evident reclosable bag comprising:

a first wall comprising a bottom edge, a top edge, and first and second side edges;

a second wall comprising a bottom edge, a top edge, and first and second side edges, said bottom edge and said first and second side edges of said second wall being joined to said bottom edge and said first and second side edges, respectively, of said first wall, thereby forming an interior region;

a first closure element integral with said first wall;

a second closure element integral with said second wall, said second closure element adapted to releasably engage said first closure element;

a tear zone comprising a section of reduced thickness relative to an adjacent region formed in at least one of said first and second walls; and a flap extending from said first wall foldable between an open position and a closed position.

* * * * *